United States Patent [19]

Rakowsky et al.

[11] 3,994,232

[45] Nov. 30, 1976

[54] PNEUMATIC MATCH THROUGH USE OF A CONICAL NOZZLE FLARE

[75] Inventors: Edward L. Rakowsky, Kinnelon; Vincent P. Marchese, Morris Township, Morris County; Robert H. Page, Piscataway; Anthony P. Corrado, Totowa Boro, all of N.J.

[73] Assignee: The United States of America as represented by the Secretary of the Army, Washington, D.C.

[22] Filed: Aug. 22, 1975

[21] Appl. No.: 606,816

[52] U.S. Cl. ..... 102/81; 102/27 F; 102/70 R

[51] Int. Cl.[2] ..... F42C 5/00

[58] Field of Search ..... 102/27 F, 27 R, 81, 102/70 R

[56] References Cited

UNITED STATES PATENTS

| | | | |
|---|---|---|---|
| 3,630,150 | 12/1971 | Rakowsky | 102/81 X |
| 3,630,151 | 12/1971 | Rakowsky | 102/81 X |
| 3,672,300 | 6/1972 | Axelson et al. | 102/81 X |
| 3,854,401 | 12/1974 | Fisher | 102/81 X |

*Primary Examiner*—David H. Brown
*Attorney, Agent, or Firm*—Nathan Edelberg; A. Victor Erkkila; Max Yarmovsky

[57] ABSTRACT

An improved pneumatic match utilizes a vented conically shaped nozzle flare positioned in a downstream region of a convergent nozzle to permit the match to be used in applications where fast functioning time is a necessity and where the fluid activating medium comprises a low helium pressure source or only high pressure air.

1 Claim, 3 Drawing Figures

PNEUMATIC MATCH THROUGH USE OF A CONICAL NOZZLE FLARE

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

Various means have been used in the prior art to enable flueric igniters to function in short intervals of time. One of the ways of making a pneumatic match reach high operating temperatures fast was to use helium gas as the fluid driving medium. When only air was available as the driving medium, the helium style pneumatic match did not function satisfactorily over a pressure range of 40 psig. to over 1000 psig. At pressures greater than 300 psig. no combination of physical parameters between nozzle and resonance tube used in the prior art helium pneumatic match could effectively produce even marginal thermal output.

SUMMARY OF THE INVENTION

The present invention relates to an improved pneumatic match which enables an air activated flueric igniter to be operational at gas supply pressures over a range from 40 psig. to 1000 psig. The present invention produces thermal outputs ranging from 100° C. to 1000° C. at supply pressures of 40 psig. or higher, there being no known upper limit on the air supply pressure. The introduction of a conically flared vented interaction region or chamber intermediate the downstream end of a convergent nozzle and a resonance tube has been found to be important to the performance of the present improved pneumatic igniter. It has been experimentally determined that in the present invention fluid pressure waves exiting from the resonance tube are reflected back into the nozzle jet stream when the nozzle exit wall is placed at an angle of approximately 30° from a plane normal to the longitudinal axis of the nozzle. This reflection causes the driving jet within the nozzle to contract to a greater extent than previously possible and then move very rapidly to fill the downstream resonance tube. The effect of these reflections is to make the oscillations of the standing shock wave increase in amplitude. These phenomena allow operation with an air supply at lower helium gas supply pressure than was previously possible with prior art pneumatic match configurations.

An object of the present invention is to enable a flueric igniter to be operational, using air as a driving medium at air supply pressures over the range from 40 psig. to over 1000 psig.

Another object of the present invention is to provide an improved pneumatic match having a conically shaped nozzle flare interaction region positioned intermediate a nozzle exit and a resonance tube which produces usable thermal output therefrom at air supply pressures greater than 40 psig.

Another object of the present invention is to provide an improved pneumatic match which produces a sufficiently large thermal output at the end wall of a resonance tube which is capable of igniting an explosive charge.

A further object of the present invention is to provide an improved pneumatic match which is capable of producing a large thermal output without having an upper limit on the air supply pressure used to initiate the match.

For a better understanding of the present invention, together with other and further objects thereof, reference is made to the following descriptions taken in connection with the accompanying drawings.

BRIEF DESCRIPTION OF THE DRAWING

Throughout the following description like reference numerals are used to denote like parts of the drawings.

DESCRIPTION OF THE PREFERRED EMBODIMENTS

Figure 1:
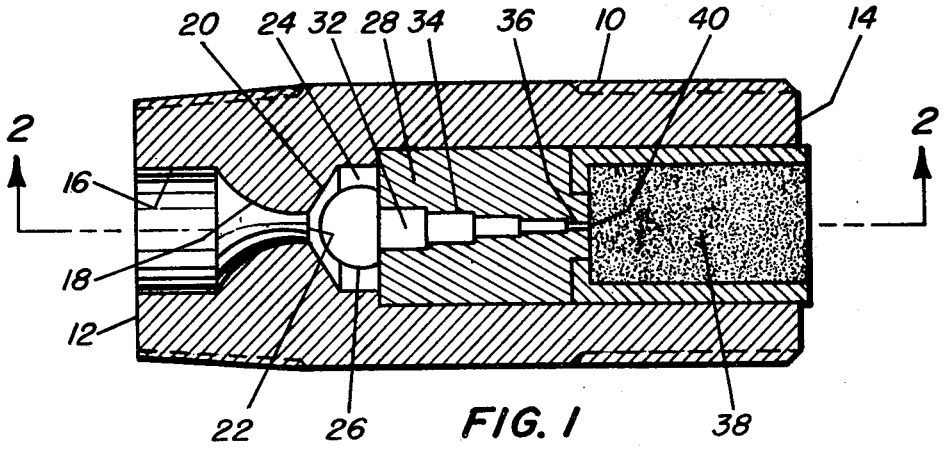
FIG. 1 is a diametral cross-sectional view of the improved pneumatic match used with an explosive charge.
Figure 2:
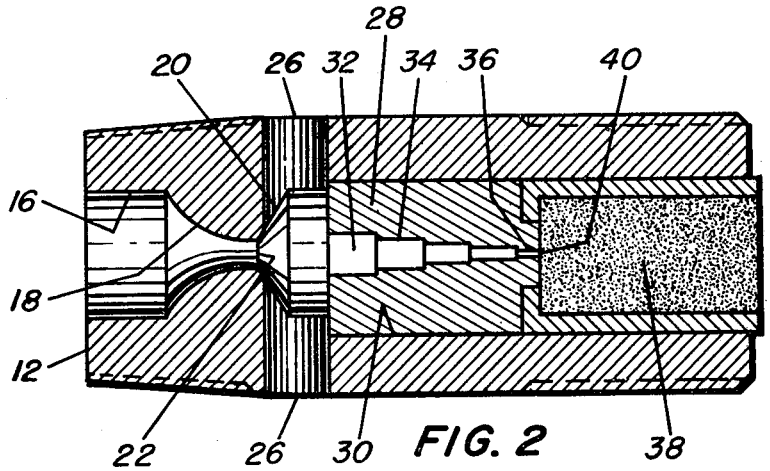
FIG. 2 is a diametral cross-sectional view taken along line 2—2 of FIG. 1.

Referring now to FIGS. 1 and 2 a cylindrically shaped housing member 10 has an externally threaded nozzle end 12 and an externally threaded detonator end 14. The nozzle end 12 has an axially disposed cylindrically shaped inlet air supply counterbore 16 therein which communicates with an axially aligned nozzle throat cavity 18. A conically shaped axially positioned nozzle flare 20 communicates with the downstream end 22 of nozzle throat 18 and with a vented axially connected interaction chamber 24, which has radial transversely disposed vents 26 communicating therewith. The conically shaped nozzle flare surface 20 makes a 30° angle with respect to a plane taken normal to the longitudinal axis of nozzle throat cavity 18. A cylindrically shaped resonance tube member 28 is operatively positioned in an axial central housing counterbore 30 so that the largest counterbore 32 of a plurality of stepped axially aligned counterbores 34 is positioned adjacent to and communicates with the downstream end of interaction chamber 24. The smallest counterbore 36 of the resonance tube stepped counterbores 34 communicates with an explosive charge 38 at end wall 40.

Figure 3:
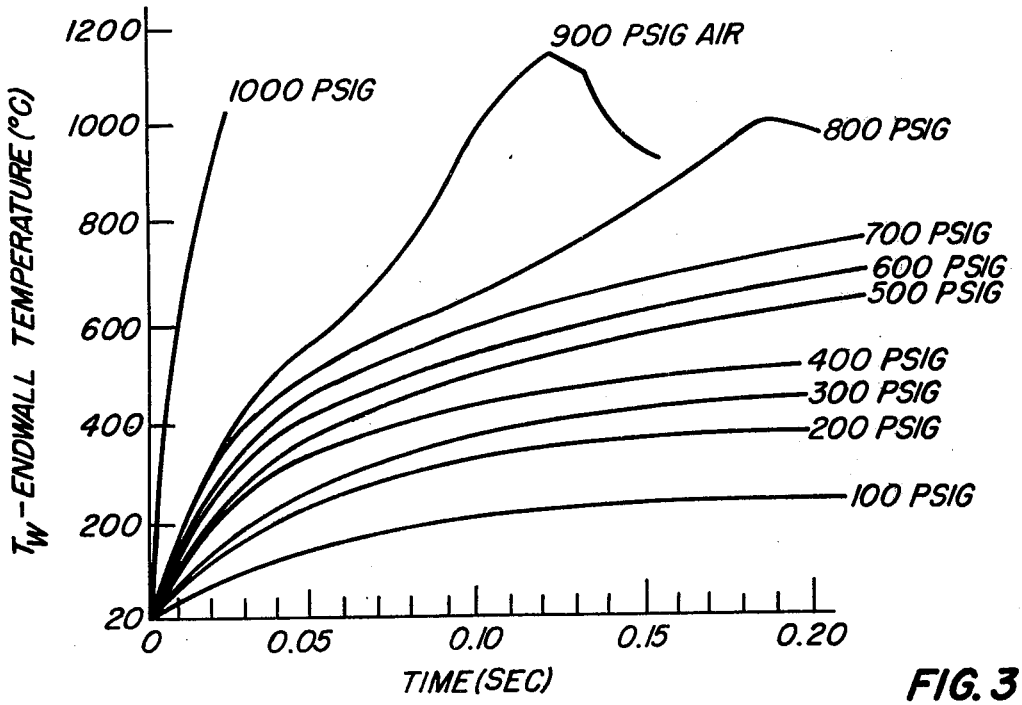
FIG. 3 is a plot of the end wall temperature in ° C. plotted as a function of time in seconds for an air driven resonance tube having a 30° vented conically shaped nozzle exit wall at various driving air pressures.

Referring now to FIG. 3 it was found that a resonance tube member 28, such as shown in FIGS. 1 and 2, would operate at all air supply pressures of 40 psig. or higher. The end wall temperature (° C.) has been plotted on the ordinate as a function time (sec.) on the abscissa at supply pressures between 100 psig. and 1000 psig. There is no upper limit on the supply pressure. At supply pressures of between 850 and 950 psig. a transition takes place and very fast temperature versus time traces are obtained. At 1000 psig. the thermal output for air is as good as for helium at 300 psig.

In operation, the device shown in FIGS. 1 and 2 functions when air is supplied at a pressure of 40 psig. or higher through the inlet air supply counterbore 16, to nozzle throat 18 and the nozzle conical flare 20 into the interaction region 24 where it impinges on the resonance tube 34. The air exits through the vents 26. The impinging flow on the resonance tube 34 sets the column of air in the tube 34 into resonance which is reinforced by the nozzle flare 20 to produce large thermal outputs at the end wall 40 of the resonance tube 34 sufficient to ignite a pyrothechnic or an explosive charge 38.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

Having thus fully described the invention, what is claimed as new and desired to be secured by Letters Patent of the United States is:

1. An improved pneumatic match which comprises:

nozzle means for generating a fluid jet stream from an air supply source and for reflecting standing shock waves back into said nozzle means which causes said jet stream to further contract within said nozzle means and causes said standing shock waves to increase in amplitude which includes;

a cylindrical housing having an externally threaded nozzle end and a detonator end, said nozzle end having an axially disposed inlet fluid supply counterbore therein, said fluid supply counterbore communicating with an axially aligned nozzle throat cavity, the downstream end of said nozzle throat communicating and axially aligned with a conically shaped nozzle flare and a cylindrically shaped interaction chamber, said interaction chamber having a plurality of diametrically transversely disposed vents therethrough, said conically shaped nozzle flare making an acute flare angle of approximately 30° with respect to a plane taken normal to the longitudinal axis of said nozzle throat cavity; said air supply source delivering air to said inlet fluid counterbore at a pressure of 40 psig to 1000 psig;

resonance tube means, axially positioned in alignment with said nozzle means, for generating said standing shock waves and a thermal output at a downstream end thereof which includes;

a cylindrically shaped member having a plurality of stepped axially aligned counterbores therein, wherein the largest of said stepped counterbores being positioned adjacent to and communicating with the downstream end of said interaction chamber, and the smallest of said counterbores communicating with said explosive means;

explosive means, axially disposed at the downstream end of said resonance tube, for initiating in response to said shock waves and thermal output being produced by said resonance tube which includes;

a detonator being thermally initiated by the downstream end wall temperature of said resonance tube.

* * * * *